US005191954A

United States Patent [19]

Ledford

[11] Patent Number: 5,191,954

[45] Date of Patent: Mar. 9, 1993

[54] LADDER RUNG SUPPORTED COMBINATION PLATFORM AND UTENSIL RACK

[76] Inventor: Jim D. Ledford, 37 Brentwood Dr., Stillwater, Okla. 74075

[21] Appl. No.: 909,326

[22] Filed: Jul. 6, 1992

[51] Int. Cl.[5] ..... E04C 7/00

[52] U.S. Cl. ..... 182/129; 182/121; 248/210; 248/238

[58] Field of Search ..... 182/129, 120, 121, 122; 248/210, 238

[56] References Cited

U.S. PATENT DOCUMENTS

| | | | |
|---|---|---|---|
| 4,445,659 | 5/1984 | LaChance | 248/210 |
| 4,476,984 | 10/1984 | Garrett | 248/210 X |
| 4,687,075 | 8/1987 | Skaggs | 182/121 |
| 4,911,265 | 3/1990 | Skaggs | 182/121 |
| 4,913,394 | 4/1990 | Schmid | 182/122 X |
| 5,031,723 | 4/1991 | Hooten | 182/129 |
| 5,052,581 | 10/1991 | Christ et al. | 220/570 |
| 5,135,193 | 8/1992 | Parris | 248/238 |

*Primary Examiner*—Alvin C. Chin-Shue

[57] ABSTRACT

A ladder platform and utility frame means is formed by a foot plate supported by adjacent ladder rungs and an open frame mounted on an elongated rod entering the lowermost ladder rung supporting the foot plate. A stub arm and lug respectively attached to the utensil frame and the foot plate stabilize the utensil frame in a substantially horizontal plane for supporting workman materials, such as paint containers and tools.

4 Claims, 2 Drawing Sheets

44
24
46
22
38
30
35
32
40
42
34
18
36
16
28

51
72
74
52
62
68
70
46
78
80
56
18
14
24
22
15
26
20
16
28
10
12

LADDER RUNG SUPPORTED COMBINATION PLATFORM AND UTENSIL RACK

BACKGROUND OF THE INVENTION

1. Field of the Invention

This invention relates to ladders and more particularly to a step platform tool and paint container shelf attachment for a ladder.

Ladders are in wide spread use but it is difficult to preform various activities on the ladder and a tradesman, such as a painter, has no means for supporting tools or other utensils while preforming his tasks.

In addition, the rungs, such as are common on aluminum ladders are too narrow to adequately support and balance the user, particularly during long periods of use.

These narrow rungs are uncomfortable to the arch of the foot and diminish the user's balance, therefore, he must prop his knee against an adjacent rung or hold onto one of the ladder uprights for support.

This invention provides a rung supported step platform and utensil support for a workman on a ladder.

2. Description of the Prior Art

The most pertinent prior patent is believed U.S. Pat. No. 5,031,723, issued July 16, 1991 to Hooten, for Ladder Accessories. This patent discloses a foot plate and a bracket-equipped elongated shaft separately supported by rungs on a ladder and stabilized relative to the ladder by clamps engaging one of the ladder uprights.

U.S. Pat. No. 4,687,075 issued Aug. 18, 1987 to Skaggs for Locking Safety Platform For A Ladder. This patent discloses a foot platform overlying a ladder rung and having fixed upright arms projecting upward from one end of the platform connected with pivoting arms which envelope intermediate portions of an upper rung in locking relation to stabilize the foot platform.

U.S. Pat. No. 4,445,659, issued May 1, 1984 to LaChance for Combination Bracket And Adjustable Ladder Tray discloses a pair of rigidly connected parallel rods which horizontally enter the rungs of adjacent upper and lower rungs with one rod projecting laterally of the ladder to support a horizontal tray adjustably positioned angularly relative to the ladder by a thumb screw and slotted arcuate bracket arm.

Numerous other prior art patents for supporting paint containers or other utensils generally disclose U-shaped or L-shaped hooks engaging adjacent upper and lower rungs for supporting the device.

An example of the state-of-the-art is U.S. Pat. No. 5,052,581, issued Oct. 1, 1991 to Christ, et al for Ladder Supported Holding Tray. This patent features a pair of upper U-shaped hooks attached to and supporting a utensil holding tray which is stabilized by a longitudinally adjustable arm connected with a U-shaped clamp gripping an adjacent lower rung.

This invention is believe distinctive over the above referred to patents by forming a combination ladder rung supported foot plate in turn stabilizing a utensil platform principally supported by a shaft entering one of the ladder rungs.

SUMMARY OF THE INVENTION

A substantially L-shaped planar foot plate has the end edge portions of its foot and leg portion defining hook shapes for respectively engaging an upper and lower adder rung. Spring urged pins supported by the foot portion lock the foot plate to the lower ladder rung.

The leg portion of the foot plate supports a tool rack.

An elongated rod having a rectangular open frame transversely secured to one end portion is slidably received by its other end portion by the interior of the foot plate supporting rung.

A stub arm on one end of the frame cooperatively engages a lug on the foot plate for stabilizing the frame in a plane substantially parallel with the foot plate. Clamps on the frame respectively grip an upright paint container or a roller paint support tray.

The principal object of this invention is to provide a ladder rung supported combination foot plate and utensil support.

DESCRIPTION OF THE PREFERRED EMBODIMENTS

Figures 1, 2:
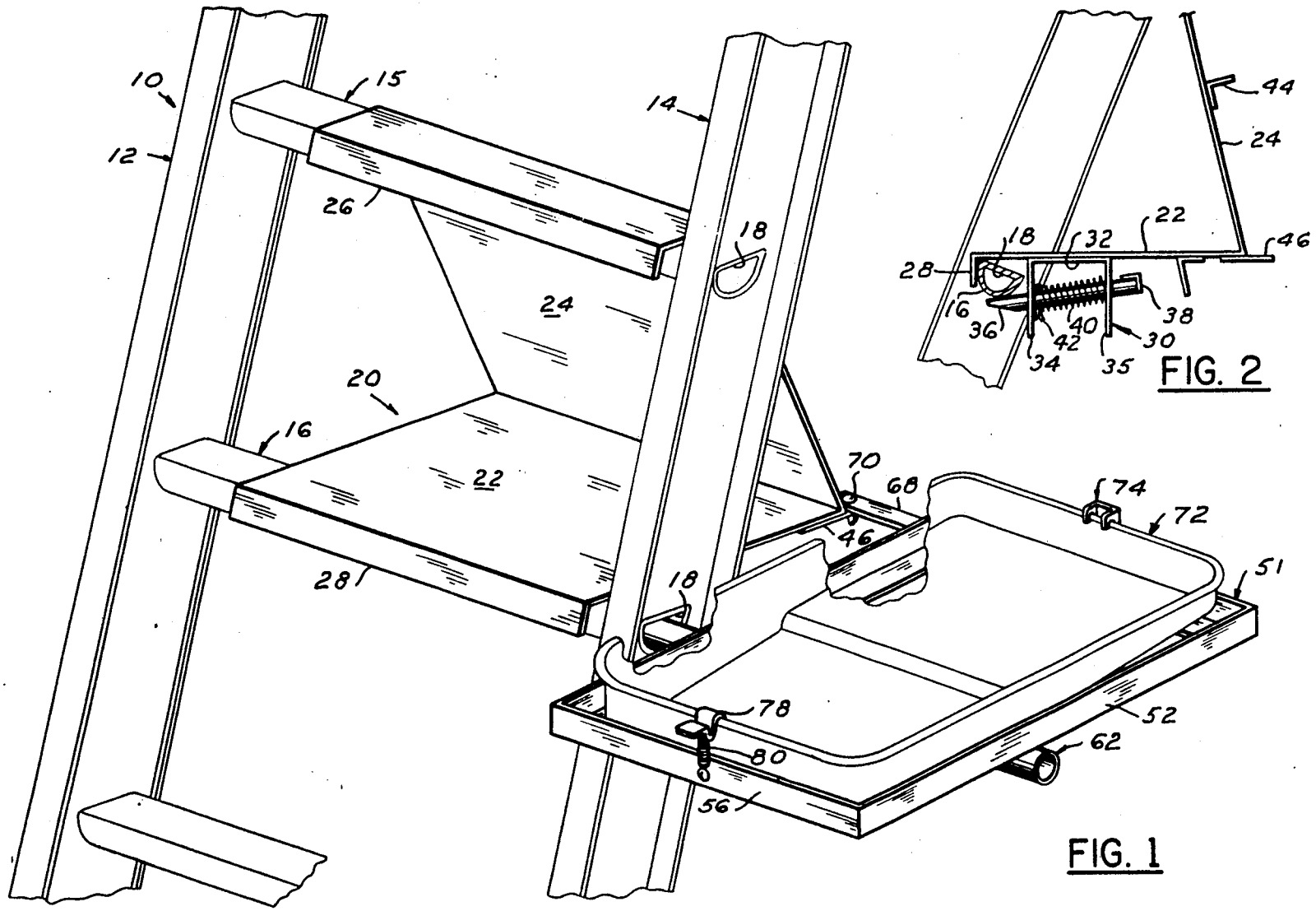
FIG. 1 is a perspective view of the device in operative position on a fragment of an upright ladder and illustrating a paint roller tray in supported position.
FIG. 2 is a fragmentary side elevational view of the foot plate, supported by one rung of a ladder.

Like characters of reference designate like parts in those figures of the drawings in which they occur.

In the drawings:

The reference numeral 10 indicates a fragment of a conventional ladder formed by parallel I-beam uprights 12 and 14 transversely interconnected by hollow rungs 15 and 16. Each of the rungs are substantially D-shaped in transverse section with the flat surface of the D-shape disposed upwardly to form the ladder rung step.

The above description is conventional with aluminum ladders presently in use and is set forth to show the type with which the device of the present invention is designed to be used.

The reference numeral 20 indicates a ladder step platform which is substantially L-shaped in side elevation. The step platform comprises a planar foot plate 22 integrally attached to an upright leg portion 24. The upper end portion of the leg portion 24 is transversely bent back upon itself to substantially form an inverted U-shaped hook 26 which overlies a selected ladder rung 15.

The foot plate 22 end portion opposite its leg 24 is angularly bent downwardly at 90° to form a depending lip portion 28 projecting downwardly adjacent the forward (toward a workman) surface of the next adjacent or lower rung 16.

A pair of inverted U-shaped foot plate anchor brackets 30 are secured in parallel transversely spaced relation by their bight portions 32 to the depending surface of foot plate 22. The parallel depending legs 34 and 3 of the respective anchor bracket 30 are transversely apertured in aligned relation for slidably receiving a locking pin 36 underlying at its forward end portion the depending surface of the ladder rung 16.

The other ends of the pins 36, projecting rearwardly of the anchor bracket leg 35, are interconnected by a bar 38 for simultaneously moving both pins 36 rearwardly in a foot plate unlocking relation. Such movement being interrupted by an angular stop 39 similarly secured to the depending surface of the foot plate 22.

A spring 40 surrounds each locking pin 36 between the inner surface of the bracket leg 35 and a cotter pin 42 transversely received by the respective locking pin 36, normally adjacent the inward surface of the anchor bracket leg 34, for normally biasing the pin 36 into locking engagement with the ladder rung 16.

Intermediate its height, the rearward surface of the support platform leg 24 has an angular horizontal tool rack 44 horizontally secured thereto for receiving tools used by the workman on the ladder.

Additionally, a strap iron lug 46 is secured at one end portion to the lateral rearward depending limit of the foot plate 22 and projects, at its apertured rearward end portion, beyond the plane of the leg 24 for the purposes presently explained.

Utility frame means 50 is supported by the ladder rung 16 and step means 20. The frame means 50 comprises a frame 51 having parallel sides 52 and ends 54 and 56. The frame sides and ends are formed from angular material having a horizontal inward flange 58 and a vertical flange 60.

The frame 51 transversely overlies one end portion of an elongated rod or tube 62 and is secured by its flange 58 to the tube 62 by screws 64, only one being shown.

The other end portion 6 of the tube loosely enters the hollow interior 18 of the ladder rung 16 for horizontally supporting the frame 51. A stub arm 68 projecting laterally from the ladder side of the frame end 54 overlies and is secured to the foot plate lug 46 by a screw 70.

Figure 3:
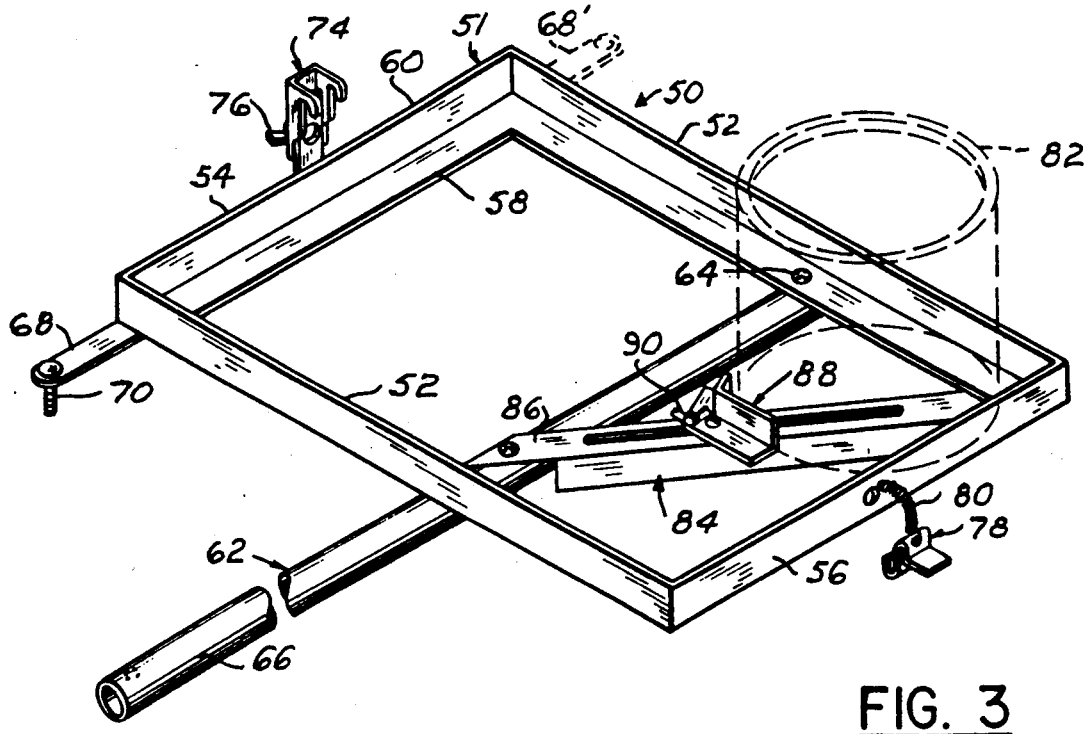
FIG. 3 is a perspective view of the utensil support frame, illustrating by dotted lines, an upright paint container supported thereby; and, FIG. 4 is a bottom perspective view of the foot plate.

An inverted J-shaped hook bracket means 74 vertically, adjustably secured to the frame end 54 by thumb screw means 76, normally engages one end of the upper edge surface of a painter's roller paint tray 72 to anchor one end portion of the tray 72 (FIGS. 1 and 3). The opposite end of the tray is secured by a clip 78 connected with the frame end 56 by a spring 80.

When the tray 72 is not being used, a paint can indicated by the dotted lines 82 is supported on the frame 51 by a slotted bar 84 which extends diagonally across one end portion of the frame from one corner thereof and is anchored at its other end portion 86 to the tube 62. A substantially V-shape, sliding bracket 88 overlies the slotted bar 84 for frictional contact with a peripheral portion of the depending end of the paint bucket 82 with the bracket 88 being thumb screw secured along the bar slot as at 90.

Figure 4:
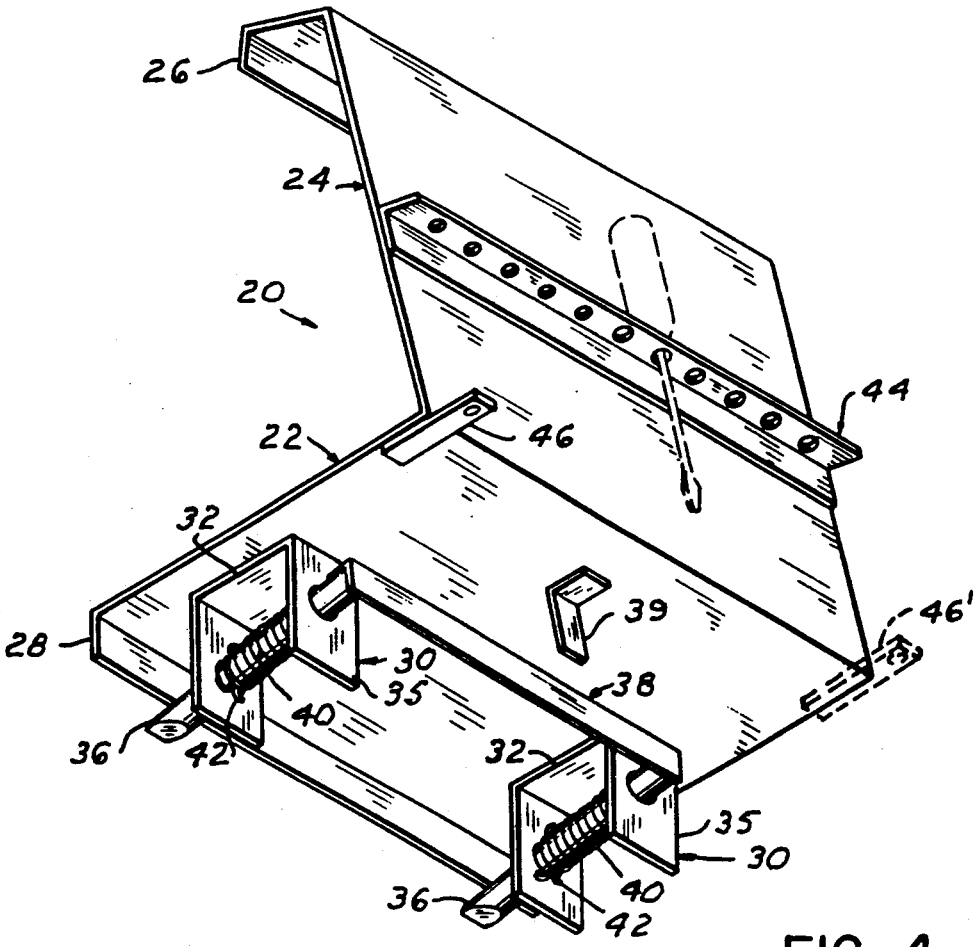

The utility tray means 50 is illustrated in the example shown for use by a right-handed person, but obviously can be adapted for a left-handed person's use by positioning the strap lug, 46 as shown by the dotted lines 46' (FIG. 4), and attaching a second or disposing the stub arm 68, as indicated by the dotted lines 68' (FIG. 3) on the opposite end of the bracket end member 54 and similarly placing the frame 51 on the opposite end portion 66 of the tube 62.

Obviously the invention is susceptible to changes or alterations without defeating its practicability. Therefore, I do not wish to be confined to the preferred embodiment show in the drawings and described herein.

I claim:

1. A tradesman's equipment support means for use on a ladder having forward and rearward surfaces and having spaced uprights joined by vertically spaced hollow open end horizontal rungs, comprising:

a generally L-shaped foot plate having a front edge portion projecting substantially horizontal forward through the ladder and overlying a ladder rung and having a leg portion opposite its front edge portion terminating upwardly in an inverted U-shaped hook overlying the next adjacent upward rung of the ladder;

means on said foot plate for preventing movement thereof relative to the first named ladder rung;

an elongated rod extending at one end portion into the first named rung and projecting laterally of one ladder upright at its other end portion;

a generally horizontal frame having opposing ends and having one end portion overlying and supported by said rod other end portion; and, frame stabilizing means for connecting said foot plate with the end portion of said frame opposite said rod.

2. The support means according to claim 1 in which the stabilizing means comprises:

an outstanding lug secured to an edge surface of said foot plate;

outstanding arm secured to an edge surface of said frame; and, screw means joining said lug and said arm together.

3. The support mean according to claim 1 in which the edge portion of said foot plate opposite its leg is turned downwardly normal to the foot plate and the foot plate means comprises:

an inverted U-shaped bracket secured by its bight portion to the depending surface of said foot plate and having depending legs transversely apertured in aligned relation;

a lock member slidably received by said apertured legs; and, spring means normally biasing said lock member toward said first named rung.

4. The support means according to claim 1 in which the edge portion of said foot plate opposite its leg is turned downwardly normal to the foot plate and the foot plate and support means further comprises:

a pair of inverted U-shaped brackets secured by their bight portions to the depending surface of said foot plate, each bracket of said pair of brackets having depending parallel legs transversely apertured in aligned relation;

a lock member slidably received, respectively, by the apertures in said parallel legs;

spring means normally biasing said lock members toward said first named rung;

an outstanding lug secured to an edge surface of said foot plate;

an outstanding arm secured to an edge surface of said frame; and, screw means joining said lug and said arm together.

* * * * *